United States Patent [19]

Manabe

[11] Patent Number: 4,869,505

[45] Date of Patent: Sep. 26, 1989

[54] ROULETTE PLAYING DEVICE

[75] Inventor: Katsuki Manabe, Tokyo, Japan

[73] Assignee: Sigma Enterprises, Incorporated, Tokyo, Japan

[21] Appl. No.: 120,137

[22] Filed: Nov. 13, 1987

[30] Foreign Application Priority Data

| | | | |
|---|---|---|---|
| Nov. 14, 1986 | [JP] | Japan | 61-271564 |
| Nov. 14, 1986 | [JP] | Japan | 61-271565 |
| Nov. 14, 1986 | [JP] | Japan | 61-271566 |
| Nov. 14, 1986 | [JP] | Japan | 61-175094[U] |

[51] Int. Cl.[4] ..... A63F 5/00

[52] U.S. Cl. ..... 273/142 R; 273/138 A; 273/142 B; 273/142 E

[58] Field of Search ..... 273/142 A, 142 J, 138 R, 273/138 A

[56] References Cited

U.S. PATENT DOCUMENTS

| | | | |
|---|---|---|---|
| 1,670,692 | 11/1926 | Rosar | 273/142 F |
| 1,824,647 | 6/1929 | Wright | 273/142 F |
| 3,090,623 | 4/1959 | Dugan | 273/142 R |
| 4,391,442 | 7/1983 | Levy | 273/142 E |

FOREIGN PATENT DOCUMENTS

| | | | |
|---|---|---|---|
| 559858 | 8/1957 | Belgium | 273/142 E |
| 0101522 | 2/1984 | European Pat. Off. . | |
| 0194388 | 9/1986 | European Pat. Off. | 273/142 G |
| 157465 | 6/1939 | Fed. Rep. of Germany . | |
| 740231 | 8/1943 | Fed. Rep. of Germany . | |
| 847984 | 10/1939 | France | 273/142 R |
| 467107 | 11/1951 | Italy | 273/142 E |
| 59-18072 | 4/1984 | Japan . | |
| 61-8704 | 3/1986 | Japan . | |
| 1012409 | 12/1965 | United Kingdom | 273/142 R |
| 1544962 | 4/1979 | United Kingdom . | |

*Primary Examiner*—Leo P. Picard
*Assistant Examiner*—Jessica J. Harrison
*Attorney, Agent, or Firm*—Birch, Stewart, Kolasch & Birch

[57] ABSTRACT

A roulette playing device comprises a release opening for releasing a ball. The opening is formed in a circular wall at a position higher than the level where the ball runs on the outermost circumference thereof. The circular wall is preferably tilted from a vertical plane toward a roulette wheel. Such an arrangement prevents the ball from running astray and dropping into the release opening. The roulette playing device further comprises ball sensors for detecting the ball running on the circular runway, an average speed detector for detecting the time the ball takes to run between two of the ball sensors, and a control device for outputting an instruction for prohibiting any more betting when the detected value by the speed detector reaches a preset value. Such an arrangement enables the behavior of the ball to be detected accurately and NO BETTING operation to be timed stably, whereby roulette games are made more amusing.

27 Claims, 7 Drawing Sheets

ROULETTE PLAYING DEVICE

BACKGROUND OF THE INVENTION

This invention relates to a roulette playing device played by releasing a ball into one of a number of ball pockets bearing betting marks.

The prior art of the field this invention belongs to is described in, e.g., Japanese Patent Publication Nos. 18072/1984 and 8704/1986.

The prior art roulette playing device comprises a roulette wheel, a circular runway and a circular wall, as major members. The roulette wheel is positioned at the center of the device and has a plurality of ball pockets bearing betting marks. The roulette wheel is whirled by a separate motor or other means. The circular runway surrounds the roulette wheel and has the running surface declined radially inward. The circular wall is set up from the outer boundary of the runway and is continuous therearound. A ball is let out from a release opening formed in the circular wall.

In the above-described prior art device as shown in Japanese Patent Publication No. 18072/1984, the release opening is formed in the circular wall on a level even with that where the ball is running on the runway along the outermost circumference thereof, and the running ball often accidentally falls into the release opening. The running ball often goes astray in an unanticipated direction, and this has made the game less amusing. Besides, when the ball is released at a high speed and accidentally falls into the release opening, it deviates and rebounds outside over the circular wall.

On the other hand, games are played on the roulette playing device by players putting betting coins into slots formed in the device, anticipating the ball pocket identified by a betting mark into which the ball will go. Before and after a release of the ball it is prohibited to put betting coins into slots.

In the prior art device, the prohibition of putting betting coins into slots (NO BETTING) is timed manually, i.e., by an operator of a game center. That is, an operator watches the ball running on the ciruclar runway to push a NO BETTING button or the like so as to timely reject the betting coins put in after the operation of the NO BETTING button. For automatic NO BETTING operation, it is proposed to reject the betting coins put in within a certain period of time from release of the ball.

In the device in which the NO BETTING operation is made manually by an operator, it is necessary for an operator to always attend to the device. The timing of the NO BETTING operation is irregular depending on surroundings, etc. in a game center. In the device in which the NO BETTING operation is automatically made after a certain period of time from release of the ball, the operation is badly timed when the ball goes astray.

Japanese Patent Publication No. 8704/1986 referred to above discloses the art of disposing ball sensors along the circular runway.

But the sensors are for accelerating the ball with magnetic force and not for timing the NO BETTING operation.

SUMMARY OF THE INVENTION

A first object of this invention is to provide a roulette playing device which will avoid the ball falling into the release opening and consequently going astray.

A second object of this invention is to provide a roulette playing device which can accurately detect the ball running on the circular runway (without the possibility of falling into the release opening), to regulate the NO BETTING operation so that roulette games may be more amusing.

The roulette playing device according to a first invention of the present application is characterized in that at least one release opening for letting out a ball in a circumferential direction of the circular runway is formed in the circular wall on a level higher than the lever where the ball runs on the circular runway along the outermost circumference thereof.

The roulette playing device according to a second invention of the present application is characterized in that at least one release opening for letting out a ball in a circumferential direction of the circular runway is formed in the circular wall on a level higher than the lever where the ball runs on the circular runway along the outermost circumference thereof, and in that the device comprises at least one ball sensor disposed on the circular wall at a certain interval for detecting the ball running on the circular runway past the respective ball sensors, detecting means for detecting a time difference, or an average speed between a time sensed by one of the ball sensors and that sensed by a next one of the ball sensors and control means for outputting a NO BETTING instruction when a detected value given by the detecting means reaches a preset value.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
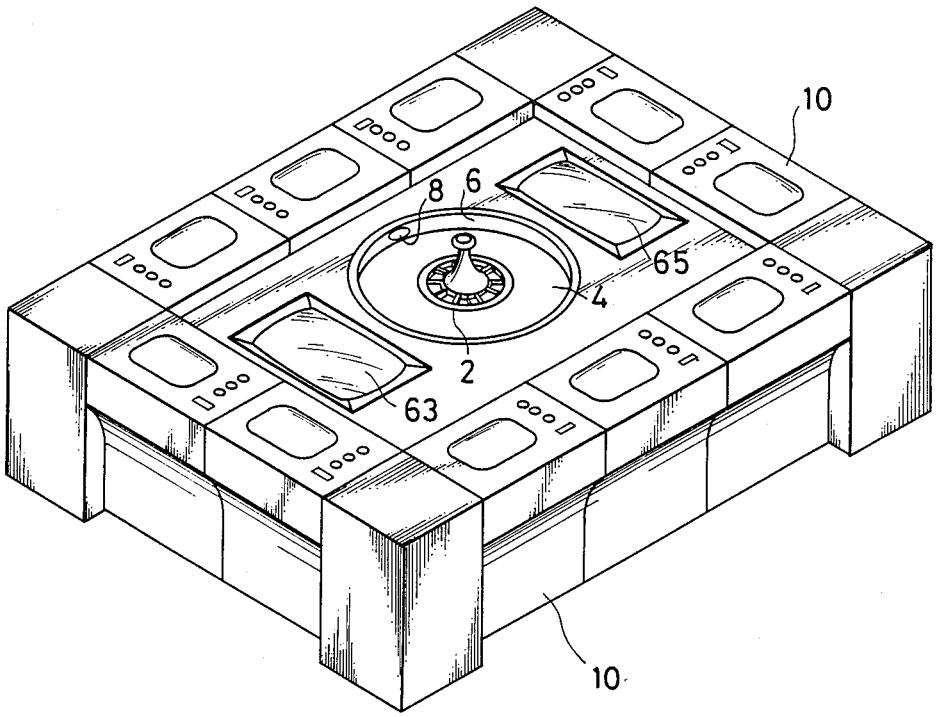
FIG. 1 is a perspective view showing the roulette playing device according to this invention.

The roulette playing device shown in FIG. 1 has a rotatable roulette wheel 2 disposed at the center thereof. The roulette wheel 2 is surrounded by a circular runway 4 which is declined radially inward. Along the outer boundary of the circular runway 4, a circular wall 6 is provided continuously there around. In the circular wall 6 there is formed a release opening 8 for letting out a ball 20 onto the circular runway 4. Ten, for example, terminal roulette playing devices 10 are provided around the roulette playing device. Players use the terminal roulette playing devices 10.

Figure 2:
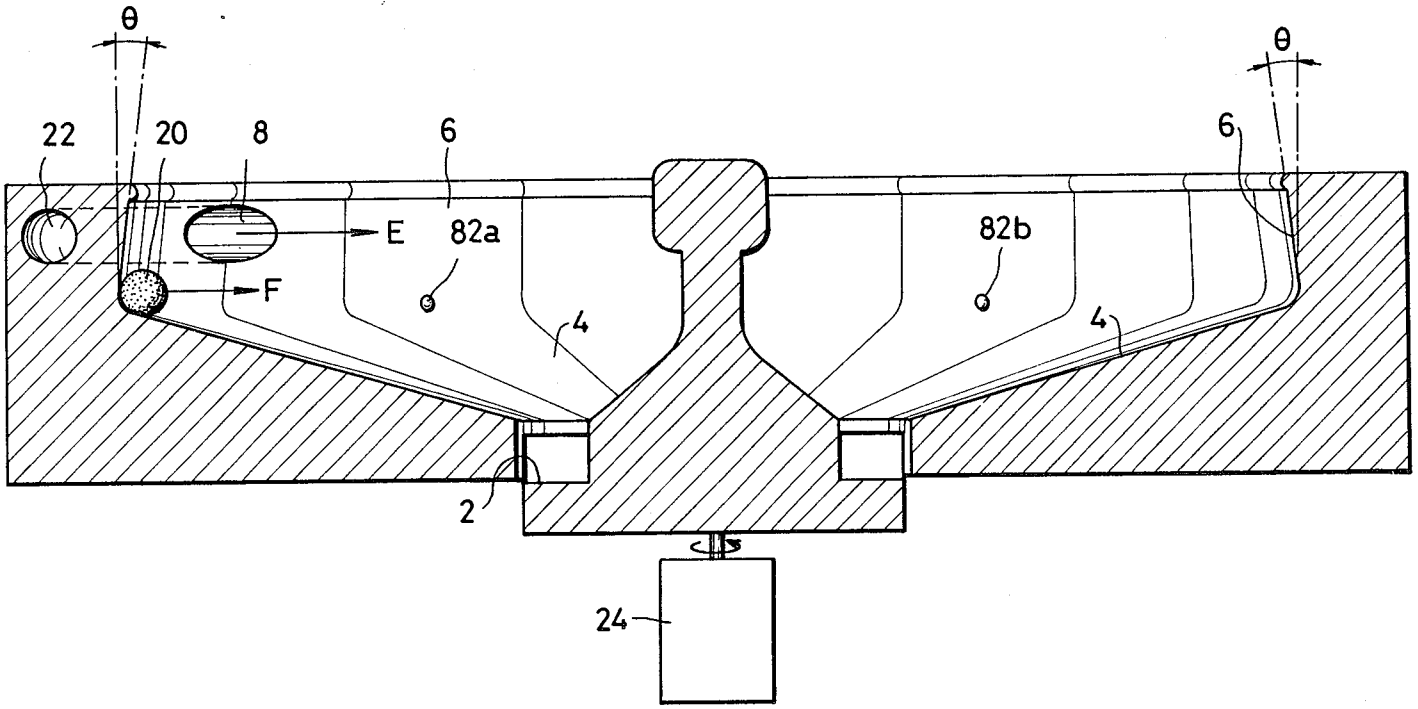
FIG. 2 is a side section view of a major portion of the roulette playing device according to an embodiment of this invention.

The major portion of the roulette playing device shown in FIG. 1 is shown in FIG. 2. The circular runway 4 and the circular wall 6 are made continuous. The circular wall 6 is tilted inward from the vertical plane by an angle $\theta$. The joint between the circular runway 4 and the circular wall 6 has a curvature radius slightly smaller than the radius of the ball 20. This arrangement brings the ball 20 running along the outermost circumference of the circular runway 4 into contact with the circular runway 4 and the circular wall 6 at the points A and B in FIG. 3.

Figure 3:
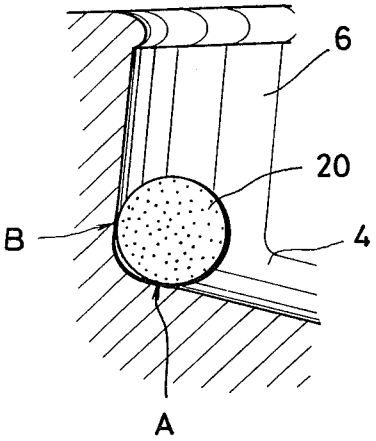
FIG. 3 is an enlarged view of the portion neighboring the circular wall in FIG. 2.

The release opening 8 is located on a level higher than the level where the ball 20 runs along the outermost circumference of the circular runway 4, i.e., at a position where the lower end of the release opening 8 is higher than the contact point of the ball 20 to the circular wall 6 (point B in FIG. 3). The release opening is in communication with an outlet 22. The roulette wheel 2 having betting marks (e.g., numbers) is whirled by a motor 24 in the direction indicated by the arrow in FIG. 2.

Figure 4:
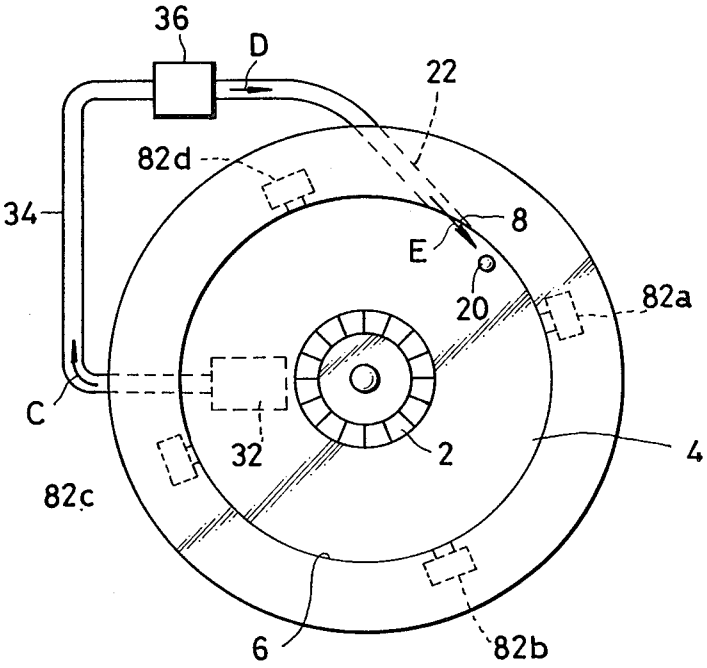
FIG. 4 is a plan view of the major portion of the roulette playing device according to the embodiment, showing an arrangement of the members.
Figure 5:
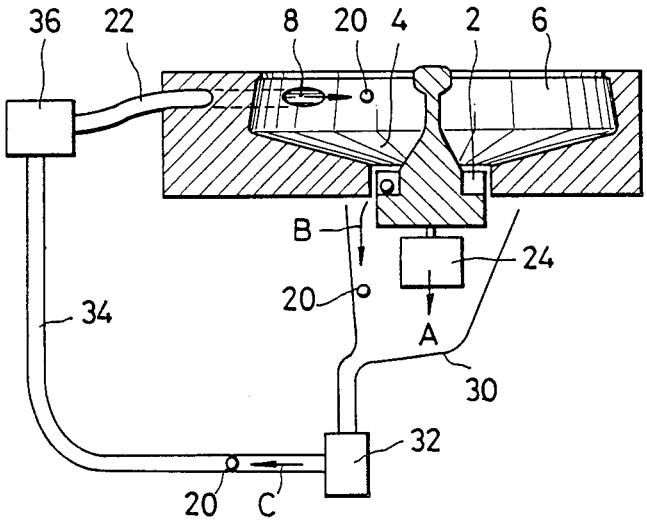
FIG. 5 is a view of the interior construction of the roulette playing device according to the embodiment, showing an arrangement of the members.

FIG. 4 is a plan view showing an arrangement of the major portion of the embodiment shown in FIGS. 1, 2 and 3. FIG. 5 shows a sectional view of FIG. 4. A funnel-shaped recovery member 30 for receiving the falling ball 20 falling down is provided below the roulette wheel 2. The recovered ball is sent to a release device 32. The release device 32 sends out the ball 20 into a release passage 34. A hitting device 36 hits the ball 20 from the release passage into an outlet 22. The ball 20 may be blown out by air as described in Japanese Patent Publication No. 18072/1984 referred to above instead of being hit out. Instead, the bouncing force of a spring or the urging force of a solenoid may be used.

Figure 6:
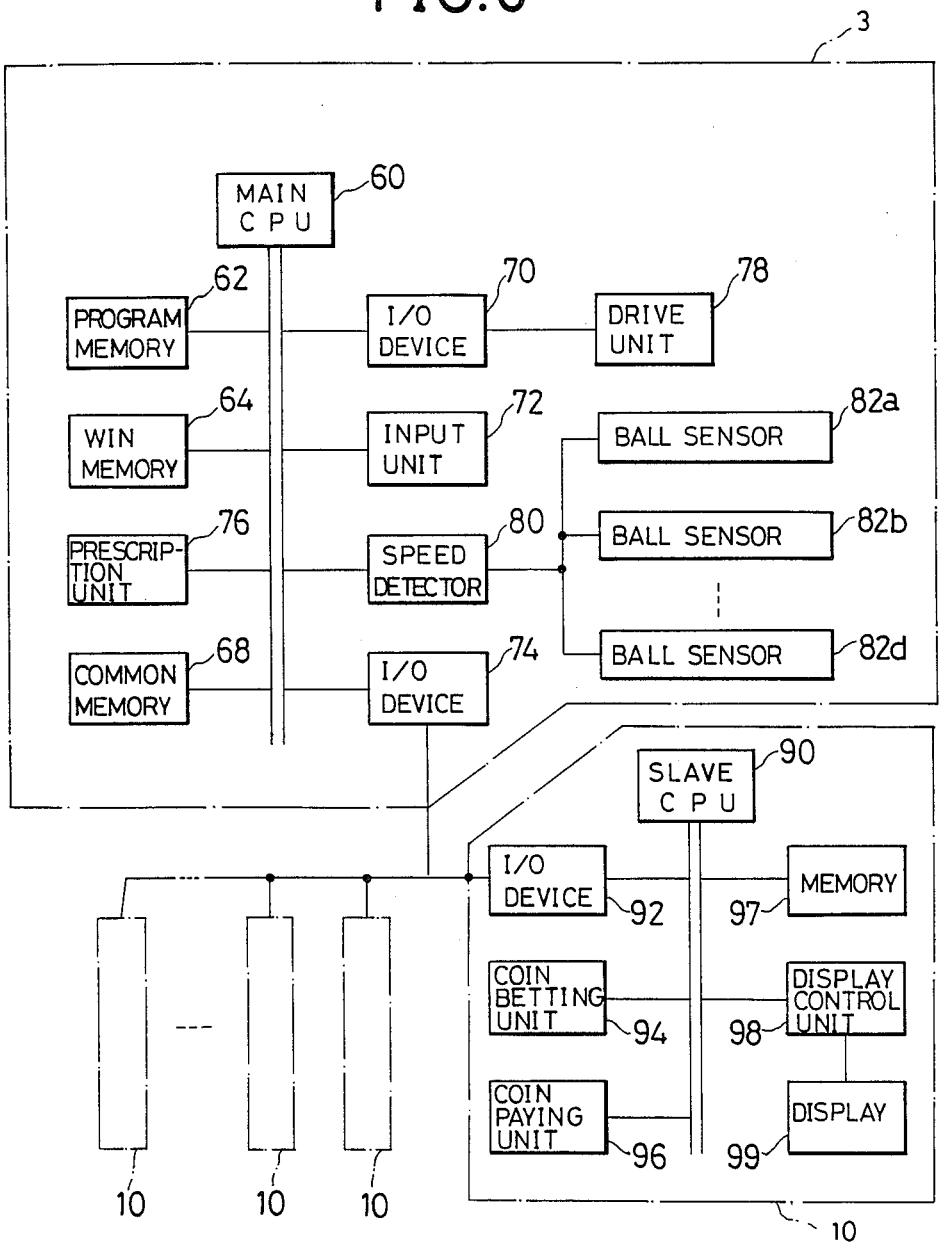
FIG. 6 is a block diagram of a control unit of the roulette playing device according to the embodiment.

A control unit of the roulette playing device according to an embodiment of this invention is arranged as shown in FIG. 6. A main CPU 60 which controls generally the roulette playing device is connected by a bus to a program memory 62, a win memory 64 and a common memory 68. The program memory 62 stores roulette game programs. The win memory 64 stores winning betting marks and their winning times, etc. The common memory 68 stores various data. The main CPU 60 is connected also to an I/O device 70 and an input unit 72. The I/O device 70 passes data between a drive unit 78 and the main CPU 60. The drive section 78 provides a motor or the like which whirls the roulette wheel 2. In the input unit 72, a game starting instruction, etc. is inputted by e.g. an operator.

The main device 3 comprising the above-described elements is connected to terminal roulette playing devices 10 through the I/O device 74, 92. Each terminal roulette playing device 10 has a slave CPU 90 which controls generally the device 10. The CPU 90 is connected by a bus to a coin receiving unit 94, a coin paying unit 96, a memory 97, and a display control unit 98. The coin receiving unit 94 receives the betting coins put in and counts the number of the betting coins. The coin paying unit 96 pays out a certain number of coins to the players who have won a game. The memory 97 stores programs for the slave CPU 90, a number of the betted coins, etc. The display control unit 98 controls the display in a display 99 in accordance with an instruction of the slave CPU 90.

The roulette playing device according to the embodiment is characterized in that the device contains in the main device 3 a prescription unit 76, a speed detector 80, and four ball sensors 82*a*–82*d*. The prescription unit 76 sets a given value corresponding to a timing of NO BETTING. The ball sensors 82*a*–82*d* sense the ball 20 running on the circular runway 4 past the ball sensors. The ball sensors are disposed on the boundary between the circular runway 4 and the circular wall 6 as indicated by 82*a*, 82*b* in FIG. 2. The speed detector 80 detects a running speed of the ball 20 based on a time difference between the times when the ball 20 passes two adjacent ones of the ball sensors 82*a*–82*d*, and on a preset distance between the two ball sensors 82*a*–82*d*.

Next, the operation of the roulette playing device according to the embodiment will be explained.

For explanation, the roulette playing device is started with a ball 20 located on the roulette wheel 2. First, the roulette wheel 2 lowers together with the drive motor 24 in the direction indicated by the arrow A. Then the ball 20 on the roulette wheel 2 falls down the recovery member 30 in the direction indicated by the arrow B and into the release device 32. The ball 20 in the release device 32 is hit out at a preset timing in the direction indicated by the arrow C and runs through the release passage 34 to the hitting device 36 and is received in the hitting device 36.

The ball 20 in the hitting device 36 is hit out synchronously with the start of a game, i.e., when players have put betting coins in terminal roulette playing devices 10 shown in FIG. 1 or are ready to do so, and besides the roulette wheel 2 is being whirled by the drive motor 24. Then, the ball 20 hit out passes through the outlet 22 in the direction indicated by the arrow D and is released onto the circular wall 6 as indicated by the arrow E.

Immediately after the ball 20 is hit out, it follows the path indicated by the arrow E in FIG. 2. At this time, gravity acts on the ball 20 downward, but since the circular wall 6 is tilted inward by an angle $\theta$ in the embodiment, a centrifugal force acts on the ball 20 outward, accordingly a component acting downward. Then the ball 20 rolls down the circular wall 6 gradually downward to reach the lower end of the circular wall 6 by the time the ball 20 makes at least one round run along the circular wall 6.

When the ball 20 comes round back to the position where the release opening is located, the ball 20 is in the running path indicated by the arrow E in FIG. 2. It does not happen that the ball 20 falls into the release opening, and accordingly the running path of the ball 20 is not disturbed. As seen from the above explanation, the inclination angle $\theta$ of the circular wall 6 is determined by a centrifugal force and gravity. That is, since a downward component is larger as a larger centrifugal acts on the ball 20, the inclination angle $\theta$ may be small. Besides, as more gravity acts on the ball 20, the inclination angle may be smaller.

Figure 7:
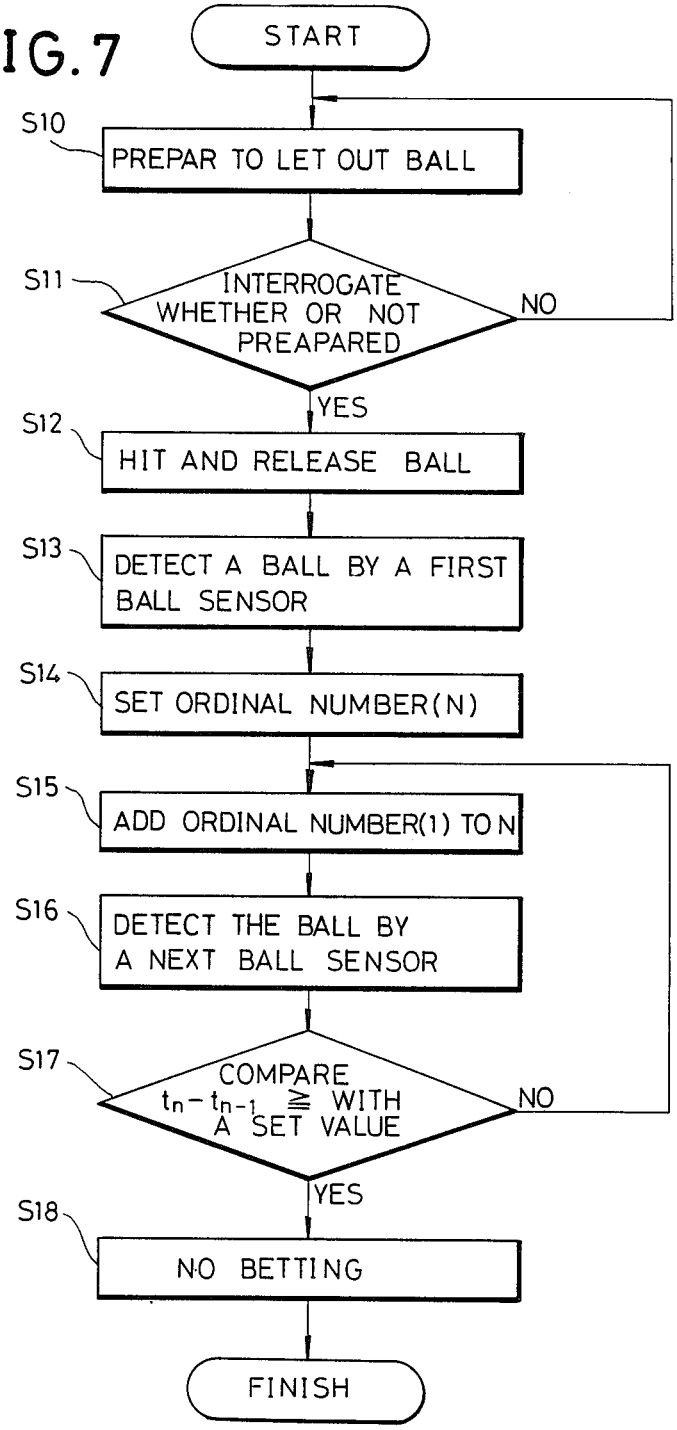
FIG. 7 is a flow chart explaining operations of the control system of FIG. 6.

Next, with reference to the flow chart of FIG. 7, the operation up to the NO BETTING will be explained. First, the preparation for letting out the ball 20 is made (S10). When the preparation is completed (S11), the ball is hit out by the hitting device 36 to be released from the release opening 8 (S12). The ball 20 released onto the circular wall 6 first passes the ball sensor 82*a*. The ball sensor 82*a* first detects the ball 20 to input the time $T_0$ when the ball 20 passed the sensor 82*a* to the speed detector 80 (S13). An ordinal number of the detection, n=0, is inputted (S14). The ordinal numbers are set in, e.g., a RAM incorporated in the device. In order to detect the ball 20 accurately it is preferable to dispose the ball sensors 82*a*–82*b* on the boundary between the circular runway 4 and the circular wall 6. By locating the ball sensors 82*a*–82*b* especially at the points A and B in FIG. 3, the possibility of ball detection error can be much lowered.

Next, 1 is added to the ordinal number n (S15), when all is set for a next detection of the ball 20. The time when the next ball sensor 82*b* detects the ball 20 is inputted as $T=t_n$ (S16). Then the difference between the time of the former ball detection and that of the latter is given as follows:

$$\Delta T=t_n-t_{n-1}=t_1-t_0.$$

Then, the difference $\Delta T=t_1-t_0$ is compared with a preset value which has been inputted to the prescription section 76 (S17). Since the distance between the ball sensors 82*a* and 82*b* are known, the speed is compared indirectly. value, 1 is added to the ordinal number n to make n=2 (S15), when all is set for a next ball detection. When the ball sensor 82*c* detects the ball 20, the difference between the time $T=t_2$ when the ball 20 passed the sensor 82*c* and the time $T=t_1$ is given as follows:

$$\Delta T=t_n-t_{n-1}=t_2-t_1.$$

Then the difference $\Delta T=t_2-t_1$ is compared with the preset value (S17).

This processing is repeated, and when a difference $T=t_n-t_{n-1}$ between the times thus detected is larger than the preset value, it is judged that the speed of the ball has become lower than the preset value, and a NO BETTING operation is made (S18). The NO BETTING operation is carried out by the main CPU 60 in accordance with the procedures stored beforehand in, e.g., a program memory 62.

When NO BETTING is operated, the ball 20 runs on the circular runway 4 gradually to the center thereof to finally go into a pocket on the roulette wheel 2. An optical sensor (not shown) detects which pocket identified with a mark the ball has entered. The detection signal is sent to the slave CPU 90, and when the game is won, a given number of coins are paid out of the coin paying unit 96.

The number of the coins thus paid is given to the main CPU 60 and stored in an addition memory 66. The displays 63, 65 shown in FIG. 1 indicate the winning terminal roulette playing device and the amount won.

This invention is not limited to the above-described embodiment and can be modified without departing from the claimed scope of this invention.

Figure 8:
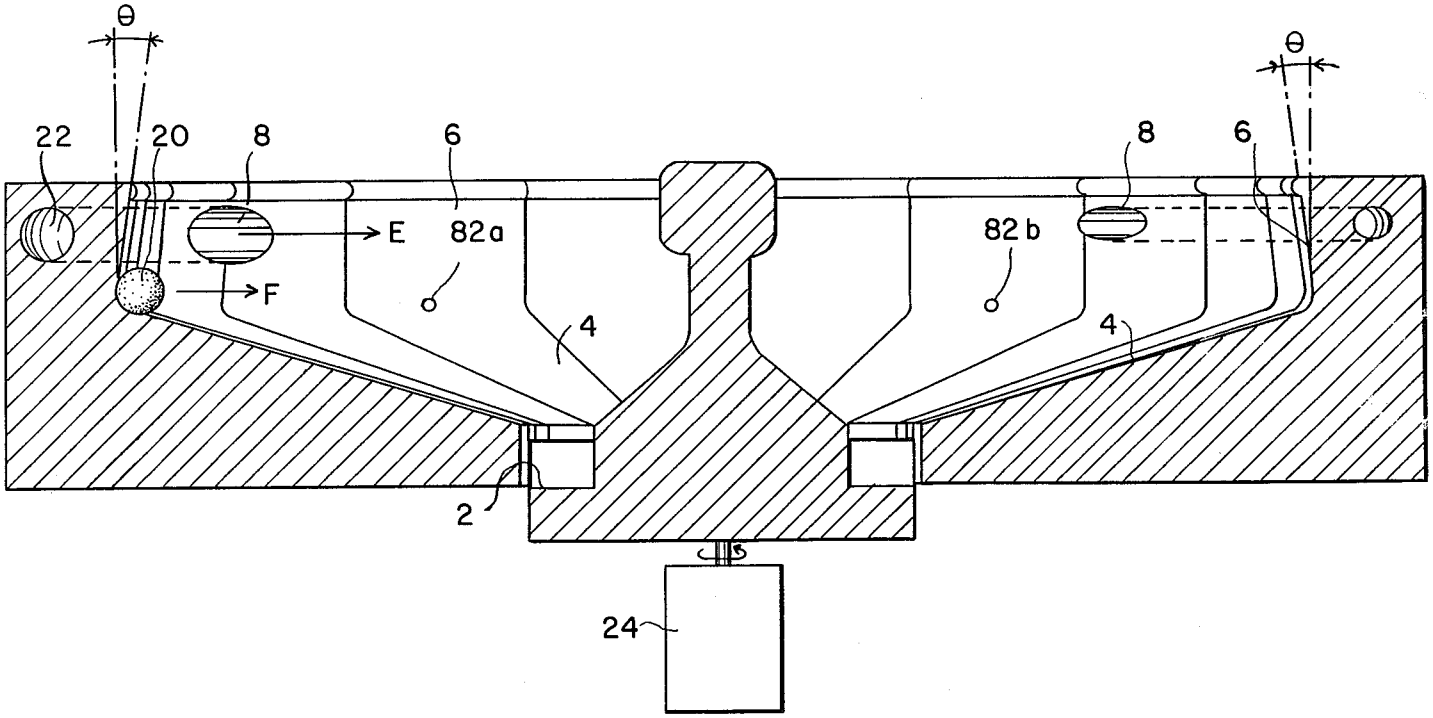
FIG. 8 is a side section view of a major portion of the roulette playing device of a second embodiment having a plurality of release openings.

To give examples, as shown in FIG. 8 two release openings 8 may be formed, opening in opposite directions to each other. The path along which the ball 20 is released from the release opening 8 may be slightly declined downward. The path may be directed slightly inward with respect to the circumferential direction of the circular wall 6.

The angle $\theta$ may be any degree which enables the ball 20 to come round back below the release opening 8 by the time the ball completes its round run along the circular wall 6. It is not essential that the circular wall 6 be a vertical plane, and it may have a vertically concave surface or other surface. The circular wall 6 does not have to be essentially tilted and may be plane when the ball 20 is made of heavy material. A gutter of concave cross-section for receiving the ball 20 may be formed in the direction indicated by the arrow F in FIG. 2.

In either embodiment four ball sensors are provided, but the number of the ball sensor is not limited to four. Three or less than three, or five or more than five ball sensors may be provided. Most preferably the ball sensor uses an optical sensor in which light is applied to the ball from a light emitting element, and the reflected light from the ball is detected. But detection may be made by the reflection of ultrasonic wave, the interruption of incident light on the ball sensor by the ball, or others.

The value set in the prescription section may be constant or variable. For example, in a first game an operator times the NO BETTING operation, and based on the timing (a running speed of the ball) determined in the first game a value is preset. In the following games the NO BETTING operation is made based on the preset value. In this case it is necessary to store the running speed of the ball (output of the speed detector) when an operator made a NO BETTING operation in, e.g. a RAM or others built in the prescription section and to use the stored value as a set value in the prescription section.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. A roulette playing device comprising:

a rotary roulette wheel having a plurality of ball pockets with betting marks, said wheel being rotatable about a rotational center;

an inclined, substantially circular runway surrounding the roulette wheel;

a substantially circular wall provided around the outer edge of the substantially circular runway continuously thereto; and at least one release opening formed in said substantially circular wall at a position higher than a portion of the wall on which a ball runs on the outermost circumference of said substantially circular runway, the ball being released from the opening to said runway, said runway and said wall meeting at a junction which has a radius of curvature smaller than a radius of the ball used in said device.

2. The roulette playing device according to claim 1, wherein the lower end of said release opening is above a position where said ball comes into contact with said substantially circular wall.

3. The roulette playing device according to claim 2, wherein said substantially circular wall is so tilted from the vertical plane thereof toward said roulette wheel as to have a larger diameter on the side nearer to said substantially circular runway than that on the upper side farther from substantially said circular runway.

4. The roulette playing device according to claim 1, wherein said substantially circular wall is tilted from the vertical plane thereof toward said roulette wheel so as to have a larger diameter on the side nearer to said substantially circular runway than that on the upper side farther from said substantially circular runway.

5. The roulette playing device according to claim 1, wherein a plurality of release openings are provided, a couple of said release openings being formed in said circular wall and opening in opposite directions to each other.

6. The roulette playing device of claim 1, wherein said release opening is stationary relative to said substantially circular wall.

7. The roulette playing device of claim 6, wherein said release opening remains opened and unobstructed throughout use of said device.

8. The roulette playing device of claim 1, wherein said substantially circular wall is nonvertical.

9. A roulette playing device comprising a rotary roulette wheel having a plurality of ball pockets with betting marks;

a substantially circular runway inclined and surrounding the roulette wheel;

a substantially circular wall provided around the outer edge of the substantially circular runway continuously thereto;

at least one release opening being formed in said substantially circular wall at a higher position than a ball running on the outermost circumference of said substantially circular runway;

at least one ball sensor for detecting the passing of a ball running on said substantially circular runway, said at least one sensor being provided on said substantially circular wall at a certain interval;

detecting means for detecting based on outputs of said at least one ball sensor a time or an average speed between the detection of the ball by said at least one ball sensor and redetection by said at least one ball sensor; and control means for outputting a NO BETTING instruction when a detected value by said detecting means reaches a preset value.

10. The roulette playing device according to claim 9, wherein said at least one ball sensor is disposed on said substantially circular wall at spaced intervals.

11. The roulette playing device according to claim 9, wherein said at least one ball sensor is disposed proximate a boundary between said substantially circular runway and said substantially circular wall.

12. The roulette playing device according to claim 11, wherein the lower end of said release opening is above a position where said ball comes into contact with said substantially circular wall.

13. The roulette playing device according to claim 12, wherein said substantially circular wall is tilted from the vertical plane thereof toward said roulette wheel to have a larger diameter on the side nearer said substantially circular runway.

14. The roulette playing device according to claim 11, wherein said substantially circular wall is tilted from the vertical plane thereof toward said roulette wheel to have a larger diameter on a side nearer said substantially circular runway than on an upper side farther from said substantially circular runway.

15. The roulette playing device according to claim 9, wherein the lower end of said release opening is above a position where said ball comes into contact with said substantially circular wall.

16. The roulette playing device according to claim 9, wherein said substantially circular wall is tilted from the vertical plane thereof toward said roulette wheel to have a larger diameter on a side nearer said substantially circular runway than a an upper side farther from said substantially circular runway.

17. The roulette playing device according to claim 9, wherein a plurality of release openings are provided, a couple of said release openings being formed in said substantially circular wall and opening in opposite directions to each other.

18. The roulette playing device according to claim 9, wherein only one ball sensor is provided.

19. The roulette playing device according to claim 9, wherein a plurality of ball sensors are provided and wherein said detecting means detects one of said time and average speed of said ball by using signals from adjacent ones of said plurality of ball sensors.

20. A roulette playing device comprising:

a rotary roulette wheel having a plurality of ball pockets with betting marks, said wheel being rotatable about a rotational center;

an inclined, substantially circular runway surrounding the roulette wheel;

a substantially circular wall provided around the outer edge of the substantially circular runway continuously thereto;

a projecting edge surrounding an upper side of said substantially circular wall and extending toward said rotational center; and at least one release opening being formed in said substantially circular wall at a position higher than a position of the wall on which a ball runs on the outermost circumference of said substantially circular runway and being formed beneath said projecting edge, the ball being released from the opening to said runway, said runway and said wall meeting at a junction which has a radius of curvature smaller than a radius of the ball used in said device.

21. The roulette playing device according to claim 20, wherein the lower end of said release opening is above a position where said ball comes into contact with said substantially circular wall.

22. The roulette playing device according to claim 20, wherein said substantially circular wall is tilted from the vertical plane thereof toward said roulette wheel so as to have a larger diameter on the side nearer to said substantially circular runway than that on the upper side farther from said substantially circular runway.

23. The roulette playing device according to claim 21, wherein said substantially circular wall is tilted from the vertical plane thereof toward said roulette wheel so as to have a larger diameter on the side nearer to said substantially circular runway than that on the upper side farther from said substantially circular runway.

24. The roulette playing device according to claim 20, wherein a plurality of release openings are provided, a couple of said release openings being formed in said substantially circular wall and opening in opposite directions to each other.

25. The roulette playing device according to claim 20, wherein said release opening is stationary relative to said substantially circular wall.

26. The roulette playing device according to claim 25, wherein said release opening remains opened and unobstructed throughout use of said device.

27. The roulette playing device according to claim 20, wherein said substantially circular wall is nonvertical.

* * * * *